US005273162A

United States Patent [19]

Riherd

[11] Patent Number: 5,273,162

[45] Date of Patent: Dec. 28, 1993

[54] METHOD AND APPARATUS FOR SEPARATING MATERIAL FROM A FLUID

[75] Inventor: James W. Riherd, Fort Pierce, Fla.

[73] Assignee: GAPC Corporation, Ft. Pierce, Fla.

[21] Appl. No.: 951,001

[22] Filed: Sep. 25, 1992

[51] Int. Cl.[5] ..... B03B 7/00

[52] U.S. Cl. ..... 209/13; 209/44; 209/157; 209/208; 209/226; 209/460; 209/494; 209/906

[58] Field of Search ..... 209/44, 13, 18, 19, 209/644, 707, 135, 136, 156, 157, 208, 232, 226, 227, 478, 454, 458, 459, 460, 494, 500, 906, 907

[56] References Cited

U.S. PATENT DOCUMENTS

| | | | |
|---|---|---|---|
| 1,611,255 | 12/1926 | Sturtevant . | |
| 1,719,442 | 7/1929 | Newsom . | |
| 2,174,925 | 10/1939 | McKeever . | |
| 3,103,941 | 9/1963 | Watters . | |
| 3,240,336 | 3/1966 | Condolios | 209/157 |
| 3,799,339 | 3/1974 | Breitholtz et al. | 209/135 X |
| 3,950,246 | 4/1976 | Klefisch . | |
| 4,089,422 | 5/1978 | Harmke et al. | 209/137 |
| 4,199,441 | 4/1980 | Ross . | |
| 4,289,355 | 9/1981 | Rose . | |
| 4,290,527 | 9/1981 | Wright | 209/458 X |
| 4,350,424 | 11/1982 | Pearson et al. . | |
| 4,394,256 | 7/1983 | Goff | 209/135 |
| 4,614,579 | 9/1986 | Dorph | 209/18 |
| 4,818,375 | 4/1989 | Dorph | 209/18 |
| 4,826,251 | 5/1989 | Balkus . | |
| 4,950,389 | 8/1990 | Pilat et al. | 209/157 |
| 4,994,176 | 2/1991 | Yakunin et al. | 209/157 |

*Primary Examiner*—D. Glenn Dayoan
*Attorney, Agent, or Firm*—James H. Beusse

[57] ABSTRACT

A method and apparatus for separating high density materials from less dense materials suspended in a fluid within a conduit. A pump generates carrier fluid motion which is fed through the conduit. Solids from a placer deposit are mixed with the carrier fluid and induced through a suction hose, then into two positively sloped separating chambers that are arranged in tandem in the conduit. The first separating chamber is cylindrical in shape, and motion of the fluid through the chamber is linear. The second separating chamber's cross section shape is rectangular, with a parabolic flow path. The second stage separator floor is variably banked, with the angle of bank and curvature increasing toward the discharge end. Solids, that are mixed with the carrier fluid, are forced along the flow path by dynamic drag of the fluid. Less dense solids travel up the positive slope at a greater velocity than more dense solids. The larger and slower moving dense solids are trapped in two sumps in the first chamber. The smaller and slower moving dense solids, that were not trapped in the first two sumps of the first chamber, slip toward the inside radius and down the banked curve, and are collected at the exit end of the second chamber in a third sump. The faster moving less dense solids in the second chamber skid toward the outside wall, up the banked curve and are then discharged.

13 Claims, 2 Drawing Sheets

METHOD AND APPARATUS FOR SEPARATING MATERIAL FROM A FLUID

BACKGROUND OF THE INVENTION

This invention relates generally to a method and apparatus for separating material from a fluid, and more particularly relates to an apparatus for recovering precious metals such as gold, silver, platinum or other dense solids from placer deposits in a liquid passing through a conduit.

Historically, devices such as a sluice have been used to recover placer gold from streams of water. Rainwater runoff and gravitational attraction move placer material downhill to a stream in valleys below. Logs or other barriers generate riffles in the stream. A screen is anchored below these riffles to retain the gold. In the gold recovery art, free gold accelerates downhill at a greater rate than aggregates, and a turbulence is needed to temporarily separate the gold from the fast moving stream. In this process the gold is trapped immediately to prevent the journey of the gold downstream and away.

Modern sluices use the basic concept and method of an open trough that is oriented downhill. A turbulent generating device, such as riffles, is provided over a retainer material which is anchored below.

Conventional sluice boxes, rockers and dry washers are used today to separate material while the solids travel down an incline plane through an open channel sluice. These modern devices take advantage of high vertical acceleration rate of dense particles through the fluid. However, when down slope paths are employed, dense solids also accelerate linearally at a higher rate than less dense solids. Due to the force of gravity, carrier fluid and solid materials' linear velocity increases throughout the flow path. Riffles placed in the path of the sluices create turbulence which generates a local low velocity and low pressure downstream to slow the dense solids. Immediate entrapment of the dense solids is critical to capturing these solids. The small dense particles remain suspended in the turbulent fluid and are lost.

A drawback to modern material removers is that linear acceleration of water also accelerates the dense solid material along the flow path and hinders the separation process. To perform proper separation, it is necessary to decelerate the velocity of gold while at the same accelerating unwanted solids.

SUMMARY OF THE INVENTION

An object of this invention is to provide an improved method and apparatus for separating material from a fluid with a conduit.

Another object of the invention is to form a material separator which is convenient to operate by having a wide latitude of orientations, to allow the separation and collection process to be checked at any time, to permit easy access to the concentrates and can be simply cleaned by draining only the sumps within the conduit itself.

It is a further object of the invention to pass fluid through a conduit which has a plurality of sumps, where one of the sumps may remove large high density material from the fluid, a second sump removes medium size high density material and the third sump removes fine size high density particles.

These and other objects are provided with a method for separating high density material from a fluid. High density materials include gold and silver and platinum, and low or less density materials typically include rocks, stones, and other aggregates. This method has a conduit which has an inlet and an outlet. A floor is provided on the bottom of the conduit and fluid is passed through the inlet, through the conduit and out the outlet. The floor of the conduit is upwardly inclined so that when fluid passes through the conduit, the fluid flows against the forces of gravity. At least a first sump is positioned on the floor of the conduit to trap high density material suspended within the fluid. When fluid is passed through the conduit an accelerating force is provided which is greater than the decelerating forces of the inclination of the floor to cause solids to accelerate up and along the floor. Unbalanced accelerating and decelerating forces act on the fluids and solids within the chambers.

The aforementioned unbalanced accelerating and deceleration forces include an external source of mechanical kinetic energy to accelerate the carrier fluids to the separator system. The total dynamic drag of the fluid tends to accelerate the solids up and along the longitudinal and vertical axes of the floor and upwardly along the longitudinal lateral and vertical axes of a second stage. This second stage directs the fluid in the conduit around a parabolic curve. A magnet is placed along the outside of the curve so that the magnetic forces from the magnet tend to accelerate magnetic materials up the bank and away from the sump area.

A decelerating force is also occurring within the chamber. As the inertia of mass tends to resist changes to acceleration, the normal gravitational force vector along the inclined floor tends to decelerate the fluids and solids that are in motion up the incline floor. Normal gravitational force along the bank curve of the floor tends to accelerate the solids toward the inside radius within the second stage chamber creating a centripetal force. Sliding friction force tends to decelerate fluids and solids throughout the flow path.

As a result of these forces and accelerations of the fluid within the chamber, large dense solids such as nuggets will tend to separate from the fluid. As a result dense solids stagnate and become trapped in the first sump. Solids that do not stagnate in the first sump are washed up and along a separator floor and over a second sump at a higher level than the first sump. Slower moving dense solids stagnate in the second sump and stratify in the bottom of the second sump.

In the second stage chamber which has a floor which is upwardly inclined and follows a parabolic path, fluid flow is also at an upwardly inclined plane along the parabolic flow and towards the vortex of the parabola. A normal gravitational force factor along the inclined plane tends to decelerate the solids that are in motion forcing these solids down the banked curve and into a sump. The slower moving dense solids slip toward the inside radius of the curvature and the faster moving less dense solids skid toward the outside of the chamber. These slow moving solids tend to be more dense and are collected in the sump.

In another aspect of the invention, an apparatus for separating solid material from a fluid is provided. This apparatus includes a chamber having an upwardly inclined floor and a sump located on the floor. An inlet is disposed at a lower end of the inclined floor and an outlet is disposed at an upper end of the inclined floor.

The fluid is forced into the chamber through the inlet and out the outlet output. When the liquid flows through the chamber the liquid flows up the incline and the denser solid materials within the incline tend to collect in the sump. The chamber is divided into two stages, a first stage near the inlet and second stage. The shape of the floor in the second stage is parabolically shaped upward which is variably banked along the curvilinear flow path.

DESCRIPTION OF THE PREFERRED EMBODIMENTS

Figure 1:
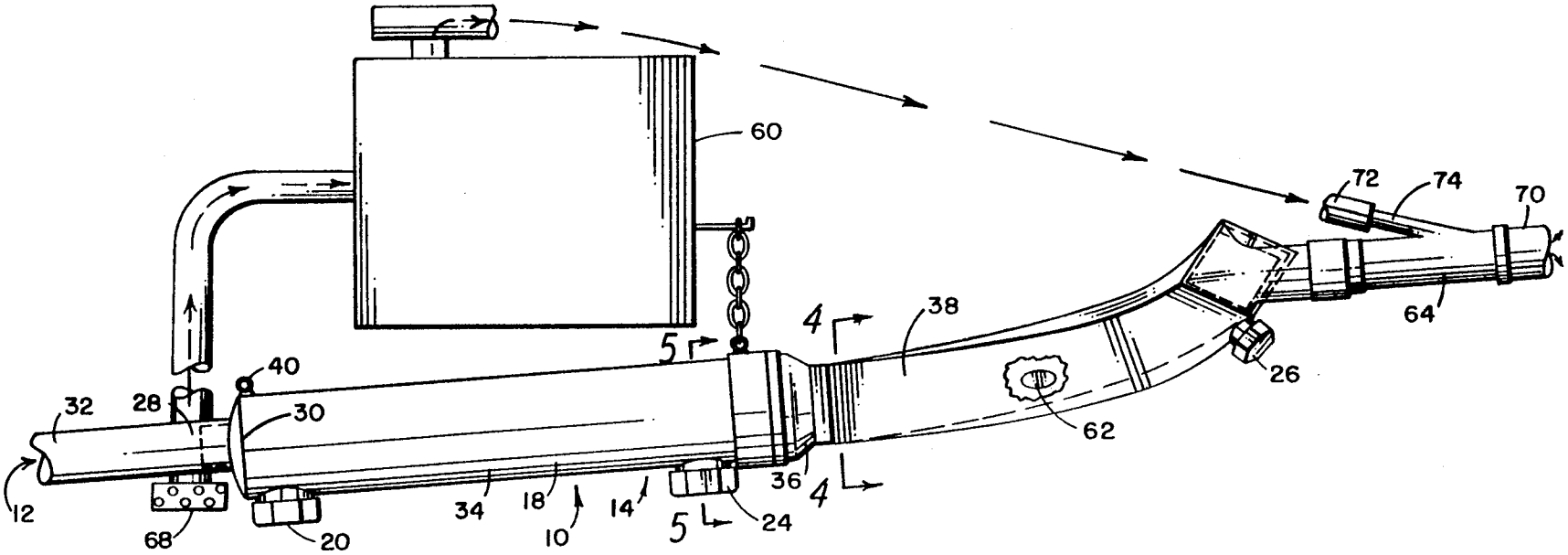
FIG. 1 is a side and partially sectioned view of the apparatus for separating materials from liquid.
Figure 2:
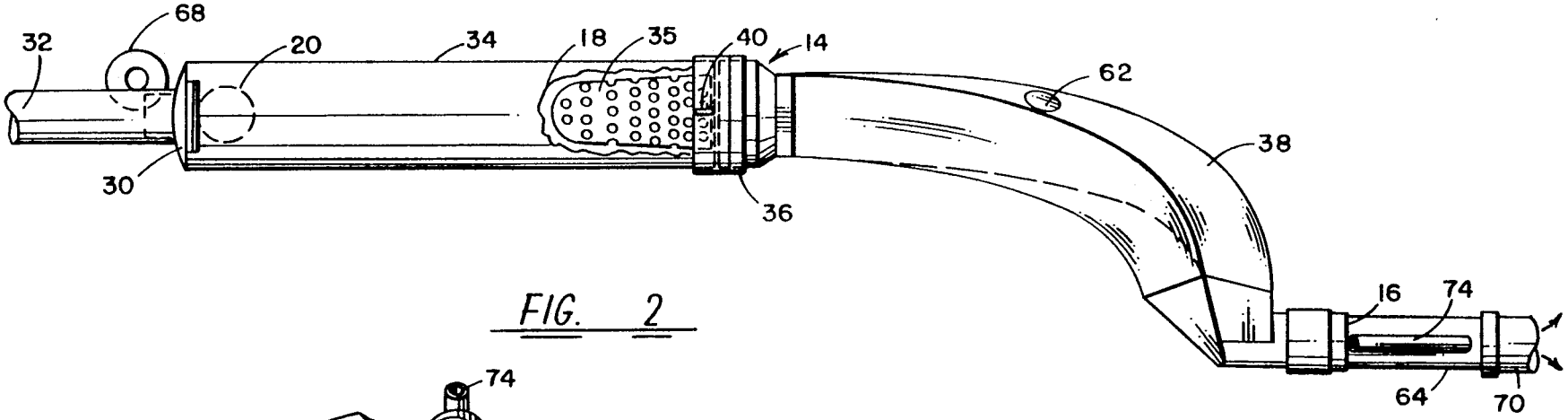
FIG. 2 is a top view of the apparatus shown in FIG. 1.

Referring to FIGS. 1 and 2, there is shown a separator assembly designated generally by the number 10 including an inlet 12 coupled through chamber 14 to outlet 16. Chamber 14 includes three sections—a first stage chamber 34, a transition section 36, and a second stage chamber 38. Chamber 34 includes a floor 18 which is positively inclined with respect to a horizontal plane and to inlet 12. Fluid passes through inlet 12, chamber 14 and outlet 16 using conventional means which will be herein described. Dense material within the fluid settles within one of sumps 20, 24 and 26 within chamber assembly 14. As used herein, fluid may be water or other liquid and may also include air.

Maximum fluid flow from pump 60 is 1860 gallons/-hour, with a maximum total head of 110 feet. Motivating fluid is delivered from pump 60 to jet pump 64 through a 0.625 diameter garden hose 72, and through 0.43 diameter jet 74. For the preferred design herein described [1½" diameter inlet and outlet, 3" diameter first stage, and 2.37" second stage walls], the optimum operating angle of chamber 34 is approximately 15°. Increased angle is required for greater fluid velocity, and decreased angle is required for lesser fluid velocity. A discharge hose 70 carries the waste material and fluid overboard. Discharge hose 70 is also a mixing chamber for the motivating fluid and the carrier fluid. A mixing chamber is critical for the jet pump 64 to function.

A short cylindrical tube 28 having inlet 12 is connected to a diffuser portion 30 at one end of chamber 34. Preferably tube 28 is connected to the outlet of a hose 32 from which the fluid originates.

Diffuser portion 30 interconnects inlet 12 and chamber 34 and acts as a circular diversion disk that reduces the fluid velocity from inlet 12 and generates a localized turbulent flow above sump 20 within chamber 34.

The first stage chamber 34 is a smooth walled cylindrical conduit located between diffuser portion 30 and transition section 36. Chamber 34 is preferably attached to an external frame by a pair of pivots or hinges 40 located at each end of chamber 34. Hinges 40 are free to rotate about the lateral axis. The first stage chamber 34 has an entrance or front sump 20 located on its floor 18 of chamber 34 adjacent the diffuser portion 30. An exit sump 24 is located on floor 18 adjacent to transition section 36. Disposed over sump 24 is a screen 35 which extends from about one-fourth of first chamber 34 to transition section 36. Screen 35 prevents large solids from lodging in sump 24.

The first stage chamber 34 provides an area for the front sump 20 and provides a streamlined fluid flow path. The first stage chamber floor 18 is upwardly inclined. A second hinge 40 is connected to the outside forward portion of stage chamber 34 and mounted to an external frame (not shown).

Figure 3:
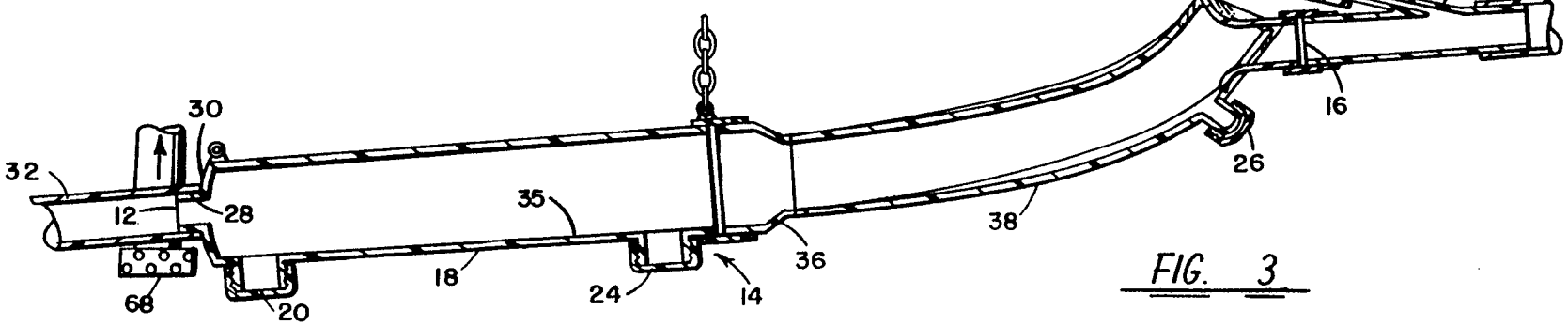
FIG. 3 is a cross-sectional view of the apparatus of FIG. 1.
Figure 5:
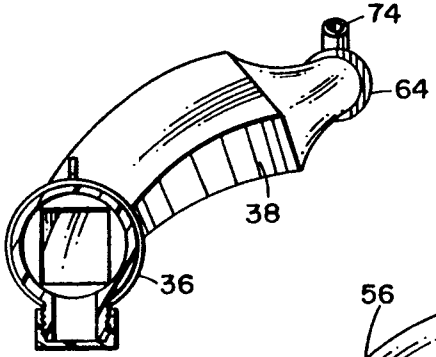
FIG. 5 is a section view along line 5—5 of FIG. 1 illustrating the transition section and parabolic shape of the second section.

Referring to FIGS. 1, 3 and 5, a transition section 36 is connected between first stage chamber 34 and second stage chamber 38. Transition section 36 has a smooth wall with its entrance adjacent the first stage chamber 34 being round and its discharge end adjacent second stage chamber 38 being shaped on its inner surface to form a square. Transition section 36 provides a chamber for continuous streamline flow and to change the cross sectional shape of the fluid from circular to square. Transition section 36 increases the fluid velocity (preferably about 25%) prior to entering the second stage chamber 38 because the inner cross-section area of the output of transition section 36 is smaller than the inner cross-section area on the input of section 36. Transition section 36 permits an orientation adjustment of the second stage chamber about its longitudinal axis orientation of the second stage chamber 38.

Figure 4:
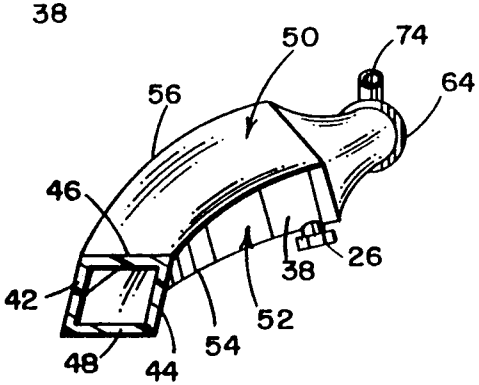
FIG. 4 is a section view along line 4—4 of FIG. 1 illustrating the parabolic shape of the second section.

Referring to FIGS. 1-4, stage chamber 38 is shaped in the form of a solid parabola as herein described. Referring to FIG. 4, second stage chamber 38 has opposing inner walls 42 and 44, 46 and 48 which in cross-section preferably forms a square. Although a square is shown, other shapes are equally applicable to the invention such as triangular, hexagonal, etc. The length-wise longitudinal shape of the walls of chamber 38 are in the form of a parabola. The second stage chamber 38 has walls that are curvilinear in the longitudinal, lateral and vertical planes. The flat pattern formula for curvature of walls is $Y^2=4fx$, where f is the focus. Preferably $f=3$ when the diameter of the first stage chamber 34 is 3.00", and wall thickness is 0.04". At $f=3$ excessive length is not required for graded yet significant and positive curvilinear shape. Two walls are formed by each parabola half ($[y]^2=12x$, and $[-y]^2=12x$) by bending each flat plate 90° along the parabola line forming edges or corners 54 and 56. Solid half parabola 50 is a mirror image of solid half parabola 52. Wall heights are preferably 2.37" measured perpendicular to, above and below the parabola lines. Four flanges not shown attach the two parabola halves 50 and 52 together and are formed outside the wall height (2.37") by bending one-half inch of material 45° opposite the direction of the parabola bend line. A preferred flow path length in second chamber 38 is 17.2".

The second stage chamber 38 is formed by joining two halves 50 and 52 together along the flanges. Each half 50 and 52 have walls 42 and 46 and walls 44 and 48 respectively. Walls 42 and 46 intersect at corner 56, and walls 44 and 48 intersect at corner 54. Each of the four intersecting corners form a parabola that is curvilinear in the longitudinal, lateral, and vertical axes.

Referring to FIGS. 1-3 exit sump 26 is located on the discharge end of the lower parabola corner and magnets 62 are attached along the outer vertical wall of second stage chamber 38. Second stage chamber provides a streamlined fluid path. Wall 48 is an upwardly inclined plane over which the fluid passes. Fluid passes through the second stage chamber 38 which provides a curvilinear banked curve flow path. Magnets 62 generate a magnetic force which operates on the magnetic materials within the second stage chamber to accelerate them up the bank of wall 48 (also referred to as a floor) and away from the exit sump 26. Exit sump 26 collects fine particles prior to fluid exiting chamber 38.

It is recognized by the inventor that solids in fluid settles in sumps 20 and 24, due to the material's low linear velocity and location. Sump 26 collects fine dense particles in fluid passing through chamber 38.

It is recognized by the inventor that centrifugal forces tend to accelerate the solids toward the outside wall of chamber 38. Vertical gravitational forces tend to accelerate solids down the banked inner wall 48 of the second stage chamber 38. Preferably the degree of bank required to keep material flowing along the center line of the curve of walls 42 and 44 is proportional to the velocity squard of material in chamber 38 and inversely proportional to the radius of curvature. Thus low density material in the fluid moves at higher velocity and will skid toward the outside walls of chamber 38. High density material in fluid moves at lower velocities and will slip toward the inside wall of the curve. These slow moving high density materials are collected in a sump. The faster moving low density materials exit chamber 38 and are discharged.

In FIG. 1, a conventional gasoline powered centrifugal pump 60 is shown, which draws fluid in through a small particle filter 68 below hose 32, and forces water into a branch of a jet pump 64 and out a discharge hose 70. A discharge hose (approx. 2 feet long) is required after the jet pump. This hose serves as a mixing chamber for the motivating and carrier water. The jet pump will not function without a mixing chamber. The fluid accelerates near the outlet 16 of chamber 14 to create a negative pressure in the jet pump 64 to evacuate chamber 14 and move fluid therethrough. Another type of pump (not shown) which may be used forces fluid from hose 32 directly into inlet 12. Either of these two pumps will generate sufficient pressure to force fluids through chamber 14 to cause dense solids and particles to separate.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method for separating relatively high density material from a fluid containing a combination of a relatively high volume of low density material and a relatively low volume of high density material, said method comprising the steps of:

providing a conduit having an inlet and an outlet;

providing a floor on the bottom of the conduit;

passing a fluid containing entrained material through the inlet and into the conduit;

diffusing the fluid as the fluid exits the inlet and enters the conduit to create turbulence in the fluid and reduce dynamic pressure to cause large, high density material to precipitate out of the fluid;

upwardly inclining the floor of the conduit so that fluid passing through the conduit flows against the force of gravity; and positioning a first sump on the floor of the conduit adjacent the inlet to collect the high density material precipitating out of the fluid.

2. The method as recited in claim 1 further comprising the steps of:

placing a magnet along the outside of the conduit; and accelerating magnetic material in the fluid in a direction up the inclined floor and away from the first sump.

3. The method as recited in claim 1 further comprising the step of placing a second sump on the floor downstream and at a higher horizontal level than the first sump to collect smaller, high density material.

4. The method as recited in claim 1 further comprising the steps of:

shaping the conduit to form a parabolic flow path;

directing the fluid in the conduit around the parabolic curve so that fast moving low density solids travel along the outside of the curve and slow moving high density solids travel along the inside of the curve;

separating low density material from high density material in the fluid by upwardly migrating the low density solids in the fluid along the outside of the curve toward the outlet; and separating the high density material from the flow by migrating the high density particles in the fluid along the inside of the curve toward the third sump.

5. An apparatus for separating solid material from a fluid comprising;

a chamber having a floor with an upward incline and a sump located on the floor, said chamber including a first stage chamber, a transition section and a second stage chamber, said first stage chamber having walls defining a linear fluid flow path and having the sump positioned on the floor of the first stage chamber adjacent the inlet, the second stage chamber having inner walls defining a parabolic flow chamber, said transition section being disposed between the first stage chamber and the second stage chamber with inner walls transforming from the first stage chamber to the second stage chamber;

an inlet disposed at a lower end of the inclined floor and an outlet disposed at the upper end of the inclined floor; and means for forcing a fluid into said chamber through said inlet and out of said chamber through said outlet such that when liquid flows through said chamber the fluid flows up the incline and solid materials within said incline collect in said sump.

6. The apparatus as recited in claim 5 wherein a portion of the inner walls of said chamber is shaped in the form of a parallelogram in cross section and wherein opposing inner walls of said portion of said chamber have an edge that extends parabolically in a longitudinal direction.

7. The apparatus as recited in claim 5 further comprising a magnet attached along an outer side of the second stage chamber.

8. The apparatus as recited in claim 6 wherein said outlet is connected to said parallelogram shaped chamber.

9. The apparatus as recited in claim 5 wherein said transition section transitions from a first large cross-section adjacent said first stage to a second smaller cross-section adjacent said second stage.

10. An apparatus for separating high density material suspended in a fluid comprising:

a chamber having a first stage with cylindrically shaped walls, a second stage with parallelogram shaped inner walls and a transitional stage between the first and second stage;

said transitional stage transitions from a first inner diameter adjacent one end of the first stage to a smaller inner cross-section adjacent one end of the second stage;

a cylindrical inlet connected with a diffuser shaped as a circular divergent disc to one end of the first cylindrical stage opposite from the transitional stage end;

an outlet connected to one end of said second stage opposite said transitional stage;

said chamber having a floor with a positive incline with a low level at the inlet end and a higher level at the outlet end;

a first sump disposed adjacent said inlet end on a floor of said first stage, and a second sump disposed on the floor of the first stage between said first sump and said transitional stage; and a third sump disposed in said second stage adjacent said outlet end.

11. The apparatus as recited in claim 10 wherein second stage has side parabolic walls that intersect a horizontal plane along a first parabolically shaped line; and wherein said second stage has an outside wall magnet which intersects a vertical plane along a second parabolically shaped line.

12. The apparatus as recited in claim 10 further comprising a magnet connected outside the walls of the second stage and in magnetic communication with fluid that passes through said chamber in said second stage.

13. The apparatus as recited in claim 10 further comprising means for moving fluid with low density particles through said chamber from said inlet to said outlet.

* * * * *